US007062445B2

(12) United States Patent
Kadatch

(10) Patent No.: US 7,062,445 B2
(45) Date of Patent: Jun. 13, 2006

(54) QUANTIZATION LOOP WITH HEURISTIC APPROACH

(75) Inventor: Andrew V. Kadatch, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 963 days.

(21) Appl. No.: 09/771,371

(22) Filed: Jan. 26, 2001

(65) Prior Publication Data

US 2002/0143556 A1 Oct. 3, 2002

(51) Int. Cl.
*G10L 21/00* (2006.01)

(52) U.S. Cl. ..... 704/500; 704/204; 704/230; 340/347; 348/419

(58) Field of Classification Search ..... 704/500, 704/204, 230, 229, 503, 200.1, 203; 340/347; 348/419; 341/118; 375/240.05, 240.24
See application file for complete search history.

(56) References Cited

U.S. PATENT DOCUMENTS 4,051,470 A 9/1977 Esteban et al.
4,706,260 A 11/1987 Fedele et al.
4,954,892 A 9/1990 Asai et al.
5,089,889 A 2/1992 Sugiyama
5,235,618 A 8/1993 Sakai et al.
5,317,672 A 5/1994 Crossman et al.
5,414,796 A 5/1995 Jacobs et al.
5,579,430 A 11/1996 Grill et al.
5,586,200 A 12/1996 Devaney et al.
5,623,424 A 4/1997 Azadegan et al.
5,661,755 A 8/1997 Van De Kerkhof et al.
5,686,964 A 11/1997 Tabatabai et al. ..... 348/420
5,742,735 A 4/1998 Eberlein et al.
5,787,203 A 7/1998 Lee et al.
5,819,215 A 10/1998 Dobson et al.

(Continued)

OTHER PUBLICATIONS

Jafarkhani, H., et al., "Entropy–Constrained Successively Refinable Scalar Quantization," *IEEE Data Compression Conf.*, pp 337–346 (1997).

(Continued)

*Primary Examiner*—David L. Ometz
*Assistant Examiner*—Jakieda R Jackson
(74) *Attorney, Agent, or Firm*—Klarquist Sparkman, LLP

(57) ABSTRACT

A quantizer finds a quantization threshold using a quantization loop with a heuristic approach. Following the heuristic approach reduces the number of iterations in the quantization loop required to find an acceptable quantization threshold, which instantly improves the performance of an encoder system by eliminating costly compression operations. A heuristic model relates actual bit-rate of output following compression to quantization threshold for a block of a particular type of data. The quantizer determines an initial approximation for the quantization threshold based upon the heuristic model. The quantizer evaluates actual bit-rate following compression of output quantized by the initial approximation. If the actual bit-rate satisfies a criterion such as proximity to a target bit-rate, the quantizer sets accepts the initial approximation as the quantization threshold. Otherwise, the quantizer adjusts the heuristic model and repeats the process with a new approximation of the quantization threshold. In an illustrative example, a quantizer finds a uniform, scalar quantization threshold using a quantization loop with a heuristic model adapted to spectral audio data. During decoding, a dequantizer applies the quantization threshold to decompressed output in an inverse quantization operation.

23 Claims, 3 Drawing Sheets

U.S. PATENT DOCUMENTS

| | | | | |
|---|---|---|---|---|
| 5,825,310 | A | 10/1998 | Tsutsui | |
| 5,835,149 | A | 11/1998 | Astle | |
| 5,845,243 | A | 12/1998 | Smart et al. | 704/230 |
| 5,926,226 | A | 7/1999 | Proctor et al. | |
| 5,933,451 | A | 8/1999 | Ozkan et al. | |
| 5,995,151 | A | 11/1999 | Naveen et al. | 348/420 |
| 6,029,126 | A | 2/2000 | Malvar | |
| 6,058,362 | A | 5/2000 | Malvar | |
| 6,115,689 | A | 9/2000 | Malvar | 704/503 |
| 6,160,846 | A | 12/2000 | Chiang et al. | |
| 6,182,034 | B1 | 1/2001 | Malvar | |
| 6,212,232 | B1 | 4/2001 | Reed et al. | |
| 6,240,380 | B1 | 5/2001 | Malvar | |
| 6,243,497 | B1 | 6/2001 | Chiang et al. | |
| 6,278,735 | B1 | 8/2001 | Mohsenian | |
| 6,370,502 | B1 * | 4/2002 | Wu et al. | 704/230 |
| 6,473,409 | B1 | 10/2002 | Malvar | |
| 6,522,693 | B1 | 2/2003 | Lu et al. | |
| 6,574,593 | B1 * | 6/2003 | Gao et al. | 704/222 |
| 6,654,417 | B1 | 11/2003 | Hui | |
| 6,654,419 | B1 | 11/2003 | Sriram et al. | |
| 6,728,317 | B1 | 4/2004 | Demos | |
| 6,810,083 | B1 | 10/2004 | Chen et al. | |
| 6,895,050 | B1 | 5/2005 | Lee | |
| 2002/0176624 | A1 | 11/2002 | Kostrzewski et al. | |
| 2003/0110236 | A1 | 6/2003 | Yang et al. | |
| 2003/0125932 | A1 | 7/2003 | Wang et al. | |
| 2005/0015528 | A1 | 1/2005 | Du | |
| 2005/0084166 | A1 | 4/2005 | Boneh et al. | |

OTHER PUBLICATIONS

International Organization for Standardization, "MPEG–4 Video Verification Model version 18.0," ISO/IEC JTC1/SC29/WG11 N3908, Jan. 2001, Pisa, pp. 1–10, 299–311 (Jan. 2001).

Baron et al., "Coding the Audio Signal," *Digital Image and Audio Communications,* 1996, pp. 101–128.

Cheung et al., "A Comparison of Scalar Quantization Strategies for Noisy Data Channel Data Transmission," IEEE Transactions on Communications, vol. 43, No. 2/3/4, pp. 738–742 (Apr. 1995).

Crisafulli et al., "Adaptive Quantization: Solution via Non-adaptive Linear Control," IEEE Transactions on Communications, vol. 41, pp. 741–748 (May 1993).

Advanced Television Systems Committe, "ATSC Standard: Digital Audio Compression (AC–3), Revision A," pp. 1–140 (Aug. 2001).

Gibson et al., "Chapter 7: Frequency Domain Coding," Digital Compression for Multimedia, Title Page, Contents, Morgan Kaufman Publishers, Inc., pp. iii, v–xi, and 227–262 (1998).

ITU, Recommendation ITU–R BS 1115, Low Bit–Rate Audio Coding, 9 pp. (1994).

Jayant et al., "Digital Coding of Waveforms, Principles and Applications to Speech and Video," Prentice Hall, pp. 428–445 (1984).

Ortega et al., "Optimal Buffer–constrained Source Quantization and Fast Approximation," *IEEE,* pp. 192–195 (1992).

Phamdo, "Speech Compression," 13 pp. [Downloaded from the World Wide Web on Nov. 25, 2001.]

Ramchandran et al., "Bit Allocation for Dependent Quantization with Applications to MPEG Video Coders," *IEEE,* pp. v–381—v–384 (1993).

Solari, "Chapter 8: Sound and Audio," Digital Video and Audio Compression, Title Page, Contents, McGraw–Hill, Inc., pp. iii, v–vi, and 187–211 (1997).

Westerink et al., "Two–pass MPEG–2 Variable–bit–rate Encoding," *IBM J. Res. Develop.,* vol. 43, No. 4, pp. 471–488 (1999).

ISO/IEC 11172–3, Information Technology—Coding of Moving Pictures and Associated Audio for Digital Storage Media at Up to About 1.5 Mbit/s—Part 3: Audio, 154, pp. (1993).

Dolby Laboratories, "AAC Technology," 4 pp. [Downloaded from the web site aac–audio.com on World Wide Web on Nov. 21, 2001.]

Srinivasan et al., "High–Quality Audio Compression Using an Adaptive Wavelet Packet Decomposition and Psychoacoustic Modeling," *IEEE Transactions on Signal Processing,* vol. 46, No. 4, pp. 1085–1093 (Apr. 1998).

Caetano et al., "Rate Control Strategy for Embedded Wavelet Video Coders," *Electronics Letters,* pp. 1815–1817 (Oct. 14, 1999).

Ribas Corbera et al., "Rate Control in DCT Video Coding for Low–Delay Communications," *IEEE Transactions on Circuits and Systems for Video Technology,* vol. 9, No. 1, pp. 172–185 (Feb. 1999).

Fraunhofer–Gesellschaft, "MPEG Audio Layer–3," 4 pp. [Downloaded from the World Wide Web on Oct. 24, 2001.]

Fraunhofer–Gesellschaft, "MPEG–2 AAC," 3 pp. [Downloaded from the World Wide Web on Oct. 24, 2001.]

Dalgic et al., "Characterization of Quality and Traffic for Various Video Encoding Schemes and Various Encoder Control Schemes," Technical Report No. CSL–TR–96–701 (Aug. 1996).

Gibson et al., *Digital Compression for Multimedia,* Chapter 4, "Quantization," pp. 113–138 (1998).

Gibson et al., *Digital Compression for Multimedia,* Chapter 8, "Frequency Domain Speech and Audio Coding Standards," pp. 263–290 (1998).

Gibson et al., *Digital Compression for Multimedia,* Chapter 11.4, "MPEG Audio," pp. 398–402 (1998).

ISO/IEC 13818–7, "Information Technology—Generic Coding of Moving Pictures and Associated Audio Information, Part 7: Advanced Audio Coding (AAC)," pp. i–iv, 1–145, ISO/IEC (1997).

ISO/IEC 13818–7, Technical Corrigendum 1, "Information Technology—Generic Coding of Moving Pictures and Associated Audio Information, Part 7: Advanced Audio Coding (AAC), Technical Corrigendum" pp. 1–22, ISO/IEC (1997).

Wu et al., "Entropy–Constained Scalar Quantization and Minimum Entropy with Error Bound by Discrete Wavelet Transforms in Image Compression," IEEE Transactions on Signal Processing, vol. 48, No. 4, pp. 1133–1143 (Apr. 2000).

Naveen et al., "Subband Finite State Scalar Quantization," IEEE Transactions on Image Processing, vol. 5, No. 1, pp. 150–155 (Jan. 1996).

Ortega et al., "Adaptive Scalar Quantization Without Side Information," IEEE Transactions on Image Processing, vol. 6, No. 5, pp. 665–676 (May 1997).

Ratnakar et al., "RD–OPT: An Efficient Algorithm for Optimizing DCT Quantization Tables," 11 pp.

Sidiropoulos, "Optimal Adaptive Scalar Quantization and Image Compression," ICIP '98, pp. 574–578 (1998).

Sullivan, "Optimal Entropy Constrained Scalar Quantization for Exponential and Laplacian Random Variables," ICASSP '94, pp. V–265—V–268 (1994).
Trushkin, "On the Design on an Optimal Quantizer," IEEE Transactions on Information Theory, vol. 39, No. 4, pp. 1180–1194 (Jul. 1993).
Wong "Progressively Adaptive Scalar Quantization," ICIP '96, pp. 357–360 (1996).
Wu et al., "Quantizer Monotonicities and Globally Optimally Scalar Quantizer Design," IEEE Transactions on Information Theory, vol. 39, No. 3, pp. 1049–1053 (May 1993).
Li et al., "Optimal Linear Interpolation Coding for Server–Based Computing, " *Proc. IEEE Int'l Conf. on Communications,* 5 pp. (2002).
Ronda et al., "Rate Control and Bit Allocation for MPEG–4," *IEEE Transactions on Circuits and Systems for Video Technology,* pp. 1243–1258 (1999).
Schaar–Mitrea et al., "Hybrid Compression of Video with Graphics in DTV Communication Systems," *IEEE Trans. on Consumer Electronics,* pp. 1007–1017 (2000).
Vetro et al., "An Overview of MPEG–4 Object–Based Encoding Algorithms," *IEEE International Symposium on Information Technology,* pp. 366–369 (2001).

* cited by examiner-

QUANTIZATION LOOP WITH HEURISTIC APPROACH

TECHNICAL FIELD

The present invention relates to a quantization loop with a heuristic approach. The heuristic approach reduces the number of iterations necessary to find an acceptable quantization threshold in the quantization loop.

BACKGROUND OF THE INVENTION

A computer processes audio or video information as numbers representing that information. The larger the range of the possible values for the numbers, the higher the quality of the information. Compared to a small range, a large range of values more precisely tracks the original audio or video signal and introduces less distortion from the original. On the other hand, the larger the range of values, the higher the bit-rate for the information. Table 1 shows ranges of values for audio and video information of different quality levels, and corresponding bit-rates.

TABLE 1

Ranges of values and bits per value for different quality audio and video information

| Information type and quality | Range of values | Bits |
|---|---|---|
| Video image, black and white | 0 to 1 per pixel | 1 |
| Video image, gray scale | 0 to 255 per pixel | 8 |
| Video image, "true" color | 0 to 16,777,215 per pixel | 24 |
| Audio sequence, voice quality | 0 to 255 per sample | 8 |
| Audio sequence, CD quality | 0 to 65,535 per sample | 16 |

High quality audio or video information has high bit-rate requirements. Although consumers desire high quality information, computers and computer networks often cannot deliver it.

To strike a balance between quality and bit-rate, audio and video processing techniques use quantization. Quantization maps many values in an analog or digital signal to one value. In an analog signal, quantization assigns a number to points in the signal. In a digital input signal with a range of 256 values, quantization can assign instead one of 64 values to each point in the signal. (Values from 0 to 3 in the input signal are assigned to the quantized value 0, values from 4 to 7 are assigned to the quantized value 1, etc.) To reconstruct the original value, the quantized value is multiplied by the quantization factor. (The quantized value 0 reconstructs 0×4=0, the quantized value 1 reconstructs 1×4=4, etc.) In essence, quantization decreases the quality of the signal in order to decrease the bit-rate of the signal. After a value has been quantized, however, the original value cannot always be reconstructed. (If the values from 0 to 3 are assigned to the quantized value 0, for example, on reconstruction it is impossible to determine if the original value was 0, 1, 2, or 3.)

When quantizing an input signal, several factors affect the result. For an analog signal, a dynamic range sets the boundaries of the quantization. Suppose the range of an analog signal stretches from negative infinity to infinity, but almost all information is close to zero. The dynamic range of the quantization focuses the quantization on the range of the signal most likely to yield information. For an input signal already in digital form, the dynamic range is bounded by the lowest and highest possible values.

Within the dynamic range, the number of quantization levels determines the precision with which the quantized signal tracks the original signal, which affects the distortion of the quantized signal from the original. For example, if a dynamic range has 256 quantization levels, each point in an input signal is assigned the closest of the corresponding 256 values. Increasing the number of quantization levels in the same dynamic range increases precision and decreases distortion from the original, but increases bit-rate. Quantization threshold, or step size, is a related factor that measures the distance between quantized values.

The preceding examples describe uniform, scalar, non-adaptive quantization—each point in the input signal is quantized by the same quantization threshold to produce a single quantized output value. Other quantization techniques include non-uniform quantization, vector quantization, and adaptive quantization techniques. Non-uniform quantization techniques apply different quantization thresholds to different ranges of values in the input signal, which allows greater emphasis to be given to ranges with more information value. Vector quantization techniques produce a single output value representing multiple points in the input signal. Adaptive quantization techniques change dynamic range, the number of quantization levels, and/or quantization thresholds to adapt to changes in the input signal or resource availability in the computer or computer network. For more information about quantization and the factors affecting the results of quantization, see Gibson et al., Digital Compression for Multimedia, "Chapter 4: Quantization," Morgan Kaufman Publishers, Inc., pp. 113–138 (1990).

Some adaptive quantization techniques vary dynamic range while holding constant the number of quantization levels. These techniques adapt to the input signal to maintain a relatively constant degree of quality, and they produce a relatively constant bit-rate output. One goal of these techniques is to minimize distortion between the input signal and quantized output for the number of quantization levels. Another goal is to optimize entropy, or information value, of the quantized output. The entropy of the quantized output predicts how effectively the quantized output will later be compressed in entropy compression.

Entropy is a useful measure, but many applications require exact feedback about the actual bit-rate of the compressed quantized output. For example, consider a streaming media system that delivers compressed audio or video information for unbroken playback. An entropy model of the quantized output does not guarantee that actual bit-rate of compressed output satisfies a target bit-rate. If the actual bit-rate of compressed output is much greater than the target bit-rate, playback is disrupted. On the other hand, if the actual bit-rate of compressed output is much lower than the target bit-rate, the quality of the quantized output is not as good as it could be.

The dependency between actual bit-rate of compressed output and quantization threshold is difficult to precisely express—it depends on complex, non-linear, and dynamic interaction between the entropy of the quantized output and the compression techniques used on the quantized output. The relation changes for different types of data and different compression techniques. Thus, to determine actual bit-rate of compressed, quantized output, the quantized output must be compressed with brute force, computationally expensive and time-consuming operations.

One adaptive quantization technique uses actual bit-rate of compressed output as feedback to find an optimal quantization threshold (highest fidelity to original signal) for a target bit-rate $E_{TGT}$. For a fixed dynamic range, a binary search quantizer tests candidate quantization thresholds T for a block of input data according to a binary search approach. The process of testing candidate quantization thresholds to find an acceptable quantization threshold is a quantization loop.

The binary search quantizer sets a search range bounded by $T_{HIGH}=T_{MAX}$ and $T_{LOW}=T_{MIN}$. Splitting the search range, the binary search quantizer selects a candidate quantization threshold in the middle $T_{MID}=0.5(T_{HIGH}+T_{LOW})$ and applies it to the data. The quantized output is compressed. If the resulting actual bit-rate $E_{MID}$ is acceptable, the process stops. Otherwise, the search range is halved and the process repeats. The search range is halved by setting $T_{HIGH}$ to $T_{MID}$ if the actual bit-rate $E_{MID}$ exceeded the target bit-rate $E_{TGT}$, or by setting $T_{LOW}$ to $T_{MID}$ if the actual bit-rate $E_{MID}$ fell below the target bit-rate $E_{TGT}$.

In practice, this process also stops if $|\text{ceil}(\log_L(T_{HIGH}))-\text{ceil}(\log_L(T_{LOW}))|<1$, where L is an implementation-dependent constant and ceil(x) is the smallest integer that is greater than or equal to x. This condition reflects a logarithmic dependency between absolute value of T and subjective perception. At higher values of T, humans are less sensitive to changes in T.

FIG. 1 is a graph showing the results of a quantization loop with a binary search approach (100). FIG. 1 shows a range of quantization thresholds T (110), a range of actual bit-rates $E_X$ (120) of compressed output, and a target bit-rate $E_{TGT}$ (130), which is set at 875 bits. The binary search quantizer starts with quantization thresholds 2 and 34, known to be too small and too large, respectively. The binary search quantizer selects the midpoint quantization threshold 18 and measures the actual bit-rate $E_1$ of compression operation. As $E_1$ is far below the target bit-rate $E_{TGT}$, the quantization threshold 18 becomes the new high bound. The binary search quantizer selects a new midpoint quantization threshold 10, measures the actual bit-rate $E_2$, and makes the quantization threshold 10 the new high bound. This process continues through the quantization thresholds 6 (resulting actual bit-rate $E_3$, too high) and 8 (resulting actual bit-rate $E_4$, too low) before stopping after quantization threshold 7 (resulting actual bit-rate $E_5$, acceptable).

The binary search approach finds an acceptable quantization threshold within a bounded period of time—the process stops when the search range becomes small enough. On the other hand, the binary search technique uses 5–8 loop iterations on average, depending on choice of $T_{MAX}$, $T_{MIN}$, L and other implementation details in different encoders. Each iteration involves an expensive computation of actual bit-rate of compressed output quantized according to a candidate quantization threshold. In total, these quantization loop iterations take from 20–80% of encoding time, depending on the encoder used and bit-rate/quality of the data.

SUMMARY OF THE INVENTION

The present invention reduces the number of iterations of a quantization loop by using a heuristic approach. Reducing the number of iterations instantly improves performance of an encoder system by eliminating computationally-expensive and time-consuming compression operations. Thus, the encoder system can use less expensive hardware, devote resources to other aspects of encoding, reduce delay time in the encoder system, and/or devote resources to other tasks.

To reduce the number of iterations of the quantization loop, a quantizer estimates a quantization threshold for a block of data based upon a heuristic model of actual bit-rate as a function of quantization threshold for a data type. The quantizer evaluates the actual bit-rate of compressed output quantized by the estimated quantization threshold. If the actual bit-rate satisfies a criterion such as proximity to a target bit-rate, the quantizer sets the estimated quantization threshold as the final quantization threshold. Otherwise, the quantizer adjusts the heuristic model and repeats the process with a new estimated quantization threshold.

Additional features and advantages of the invention will be made apparent from the following detailed description of an illustrative embodiment that proceeds with reference to the accompanying drawings.

DETAILED DESCRIPTION OF AN ILLUSTRATIVE EMBODIMENT

The illustrative embodiment of the present invention is directed to a quantization loop with a heuristic approach. The heuristic approach reduces iterations of the quantization loop during uniform, scalar quantization of spectral audio data.

The heuristic models actual bit-rate of compressed output as a function of uniform, scalar quantization threshold for a block of data. Initially, the model is parameterized for typical spectral audio data. A quantizer estimates a first quantization threshold based upon the heuristic model and the spectral energy of a block of spectral audio data.

The quantizer applies the first quantization threshold to the block, which is subsequently compressed by entropy coding. Depending on the actual bit-rate of the compressed output, the quantizer 1) accepts the first quantization threshold or 2) adjusts the heuristic model, estimates a new quantization threshold, and repeats the process. A quantization threshold is acceptable if it results in compressed output with actual bit-rate that falls within a range below a target bit-rate. Other acceptability criterion are possible. For example, an acceptability criterion can be based upon proximity to the target bit-rate, proximity to a target distortion, or distance between quantization thresholds in successive iterations.

The heuristic approach of the present invention can be applied to quantization loops for data other than spectral audio data. For example, after making any appropriate customizations to the heuristic model, a quantizer can process time domain audio data or video data. Although the illustrative embodiment describes uniform, scalar quantization, alternative embodiments apply a quantization loop with a heuristic approach to other quantization techniques.

The quantization loop with a heuristic approach occurs during encoding. During decoding, the compressed output is decompressed in an entropy decoding operation. The decompressed output is dequantized by applying the quantization threshold (earlier used in quantization) to the decompressed output in an inverse quantization operation.

I. Computing Environment

Figure 1:
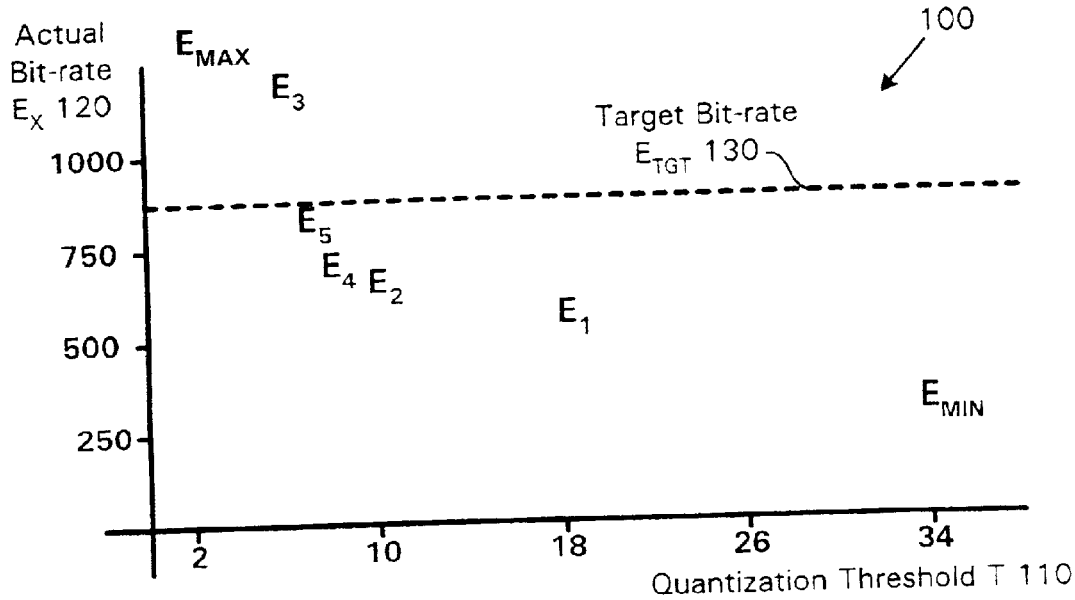
Figure 1 (prior art)
FIG. 1 is a graph showing the results of a prior art quantization loop with a binary search approach.
Figure 2:
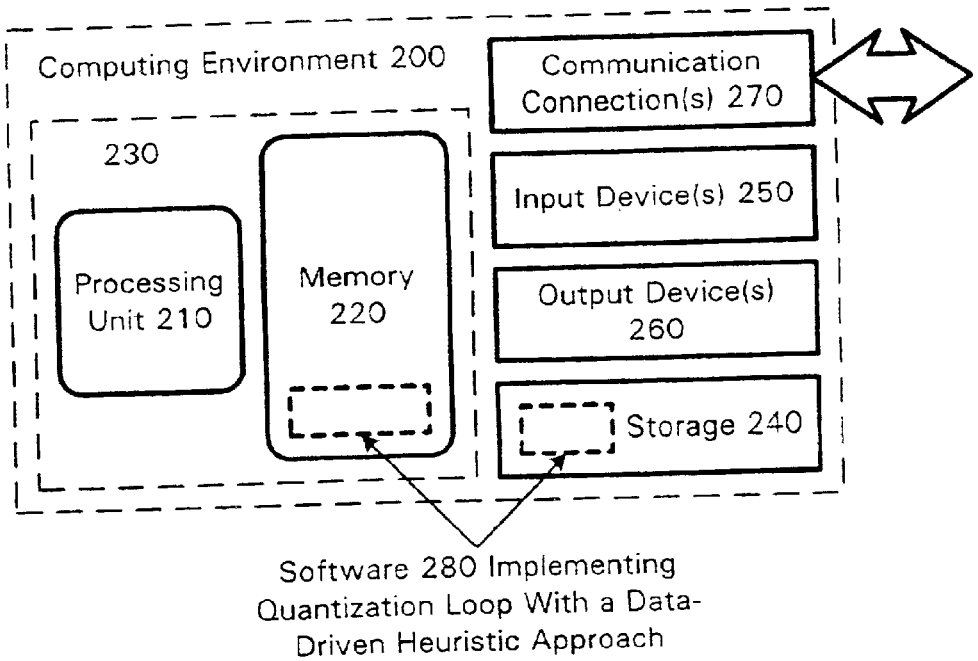
FIG. 2 is a block diagram of a computing environment used to implement the illustrative embodiment.

FIG. 2 illustrates a generalized example of a suitable computing environment (200) in which the illustrative embodiment may be implemented. The computing environment (200) is not intended to suggest any limitation as to scope of use or functionality of the invention, as the present invention may be implemented in diverse general-purpose or special-purpose computing environments.

With reference to FIG. 2, the computing environment (200) includes at least one processing unit (210) and memory (220). In FIG. 2, this most basic configuration is included within dashed line (230). The processing unit (210) executes computer-executable instructions and may be a real or a virtual processor. In a multi-processing system, multiple processing units execute computer-executable instructions to increase processing power. The memory (220) may be volatile memory (e.g., registers, cache, RAM), non-volatile memory (e.g., ROM, EEPROM, flash memory, etc.), or some combination of the two. The memory (220) stores software (280) implementing a quantization loop with a heuristic approach for an encoder system.

A computing environment may have additional features. For example, the computing environment (200) includes storage (240), one or more input devices (250), one or more output devices (260), and one or more communication connections (270). An interconnection mechanism (not shown) such as a bus, controller, or network interconnects the components of the computing environment (200). Typically, operating system software (not shown) provides an operating environment for other software executing in the computing environment (200), and coordinates activities of the components of the computing environment (200).

The storage (240) may be removable or non-removable, and includes magnetic disks, magnetic tapes or cassettes, CD-ROMs, DVDs, or any other medium which can be used to store information and which can be accessed within the computing environment (200). The storage (240) stores instructions for the software (280) implementing the quantization loop with a heuristic approach for an encoder system.

The input device(s) (250) may be a touch input device such as a keyboard, mouse, pen, or trackball, a voice input device, a scanning device, or another device that provides input to the computing environment (200). For audio or video encoding, the input device(s) (250) may be a sound card, video card, or similar device that accepts audio or video input in analog or digital form. The output device(s) (260) may be a display, printer, speaker, or another device that provides output from the computing environment (200).

The communication connection(s) (270) enable communication over a communication medium to another computing entity. The communication medium conveys information such as computer-executable instructions or other data in a modulated data signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier.

The invention can be described in the general context of computer-readable media. Computer-readable media are any available media that can be accessed within a computing environment. By way of example, and not limitation, with the computing environment (200), computer-readable media include memory (220), storage (240), communication media, and combinations of any of the above.

The invention can be described in the general context of computer-executable instructions, such as those included in program modules, being executed in a computing environment on a target real or virtual processor. Generally, program modules include routines, programs, libraries, objects, classes, components, data structures, etc. that perform particular tasks or implement particular abstract data types. The functionality of the program modules may be combined or split between program modules as desired in various embodiments. Computer-executable instructions for program modules may be executed within a local or distributed computing environment.

For the sake of presentation, the detailed description uses terms like "determine," "get," "estimate," and "apply" to describe computer operations in a computing environment. These terms are high-level abstractions for operations performed by a computer, and should not be confused with acts performed by a human being.

II. Encoder System Including Quantizer

Figure 3:
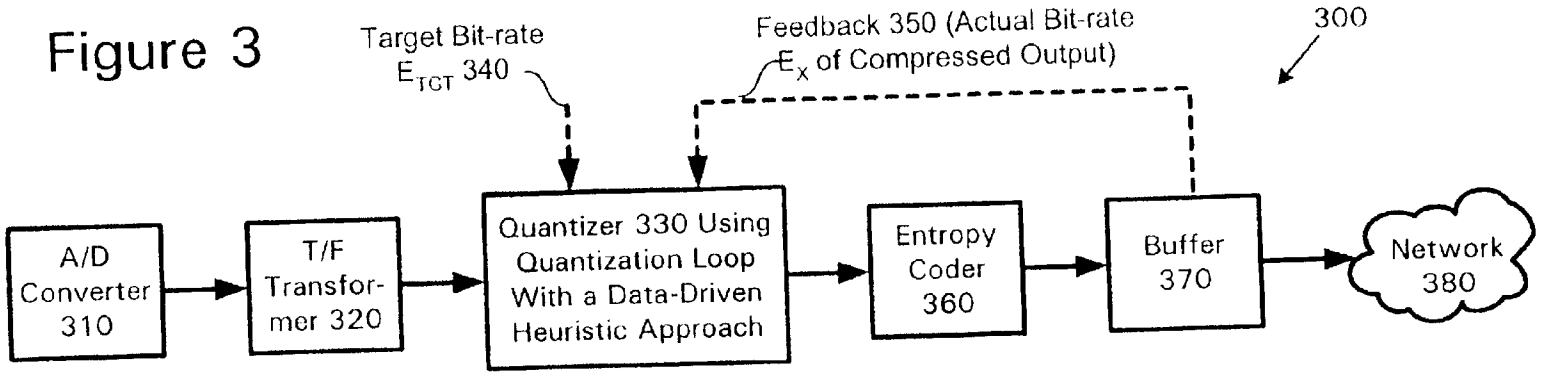
FIG. 3 is a block diagram of an encoder system including the quantizer of the illustrative embodiment.

FIG. 3 is a block diagram of an encoder system (300) including a uniform, scalar quantizer (330). The encoder system receives analog time domain audio data and produces compressed, spectral audio data. The encoder system (300) transmits the compressed output over a network (360) such as the Internet.

An analog to digital converter (310) digitizes analog time domain audio data. Although this digitization is a type of quantization, in the illustrative embodiment the quantization loop occurs later in the encoder system (300).

After or in conjunction with the analog to digital conversion, a time domain to frequency domain transformer (320) converts time domain audio data $A=\{a_j, \ldots, a_n\}$ into frequency domain (i.e., spectral) data $S=\{s_1, \ldots, s_n\}$. Typical transformations include wavelet transforms, Fourier transforms, and subband coding.

The spectral audio data is further processed to emphasize perceptually significant spectral data, a process sometimes called masking. Certain frequency ranges of spectral data (e.g., low frequency ranges) are more significant to a human listener than other frequency ranges (e.g., high frequency ranges). Accordingly, the spectral audio data is processed to make important spectral data more robust to subsequent quantization. Masking uses selective quantization, applying different weights to different ranges of spectral data. The quantization loop can be implemented in conjunction with masking, for example, by modifying a uniform scalar quantization threshold by different weights for different frequency ranges of spectral data according to perceptual significance.

The quantizer (330) quantizes a block of spectral coefficients for audio data held in a buffer (not shown). The quantizer applies a quantization threshold T set through a quantization loop to the block of data, producing quantized output. The quantization loop considers a target bit-rate $E_{TGT}$ (340) that constrains the quantization threshold T. The quantization loop receives feedback (350) indicating the actual bit-rate $E_X$ of compressed output quantized according to a candidate quantization threshold T. Eventually, the quantizer (330) stops after determining a quantization threshold is acceptable. The details of the quantization loop are provided in the following section.

The entropy encoder (360) compresses the quantized output of the quantizer (330). Typical entropy coding techniques include arithmetic coding, Huffman coding, run length coding, LZ coding, and dictionary coding. The actual bit-rate $E_X$ of the compressed block of audio spectral data quantized by the candidate quantization threshold is the basis of feedback (350) in the quantization loop. In FIG. 3, the entropy encoder (360) puts compressed output in the buffer (370), and the fullness of the buffer (370) indicates actual bit-rate $E_X$ for feedback (350). The fullness of the buffer (370) can depend on a trait of the input data that affects the efficiency of compression (e.g., uncharacteristically high or low entropy). Alternatively, the fullness of the buffer (370) can depend on the rate at which information is depleted from the buffer (370) for transmission.

Before or after the buffer (370), the compressed output is channel coded for transmission over the network (380). The channel coding can apply error protection and correction data to the compressed output.

A decoder system receives compressed, spectral audio data output by the encoder system (300) and produces analog time domain audio data. In the decoder system, a buffer receives compressed output transmitted over the network (360). An entropy decoder decompresses the compressed output in an entropy decoding operation, producing a block of quantized spectral coefficients for audio data. A dequantizer dequantizes the quantized spectral coefficients in an inverse quantization operation. The inverse quantization operation uses the quantization threshold previously determined to be acceptable by the quantizer (330). A frequency domain to time domain transformer and a digital to analog converter perform the inverse of the operations of the time domain to frequency domain transformer (320) and the analog to digital converter (310), respectively.

III. Quantization Loop with Heuristic Approach

The quantization loop selects candidate quantization thresholds based upon a heuristic model of actual bit-rate versus quantization threshold for a block of data. In the first iteration, the selected quantization threshold often yields compressed output with actual bit-rate acceptably close to the target bit-rate, thereby avoiding subsequent iterations. If not, bit-rate feedback from the first iteration is used to adjust the heuristic model, which improves the second quantization threshold. Thus, in subsequent iterations, the selected quantization threshold quickly converges on an acceptable quantization threshold.

Figure 4:
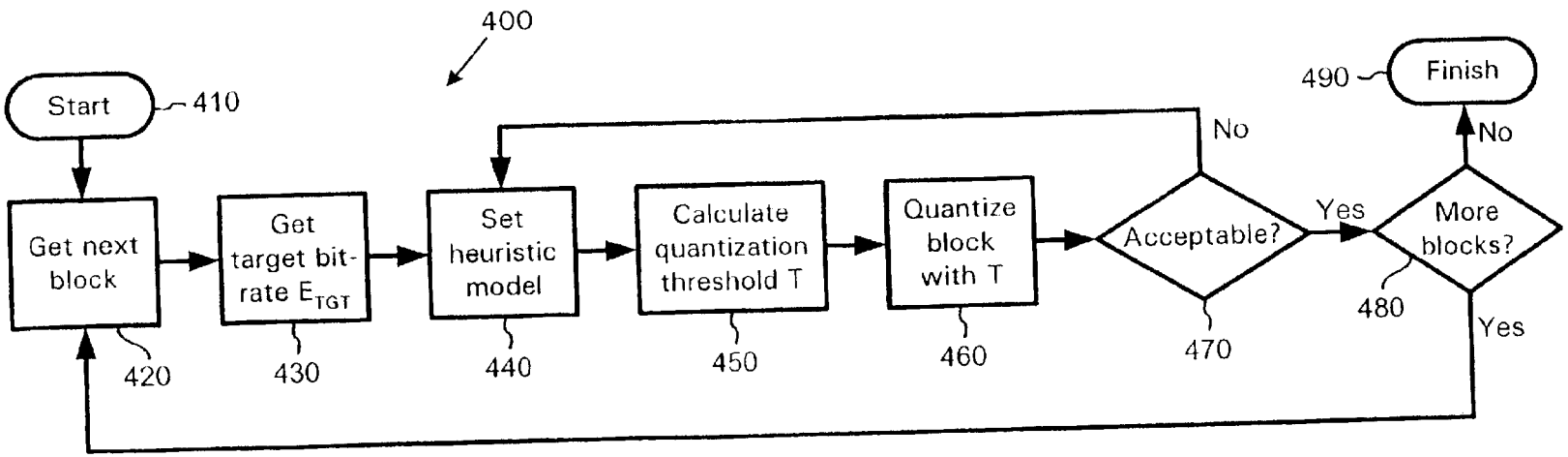
FIG. 4 is a flow chart showing a quantization loop with a heuristic approach according to the illustrative embodiment.

FIG. 4 shows a flowchart (400) for a quantization loop performed by a quantizer. At the start (410), the quantizer gets (420) a block of 1000 spectral coefficients for audio data. Other block sizes and data types are possible. Block size is an implementation decision that balances the goal of optimizing quantization for smaller blocks against the cost of finding a quantization threshold for each block.

The quantizer gets (430) the target bit-rate $E_{TGT}$ for the block of spectral coefficients. The target bit-rate gives the allowable number of bits for the compressed output under current operating constraints. A typical operating constraint is the number of bits that can be streamed over the Internet for unbroken playback, possibly factoring in current levels of network congestion. Another operating constraint could relate to processing capacity of the encoder system or a bit-rate goal for a file including the compressed output.

In the illustrative embodiment, if the actual bit-rate $E_X$ of the final compressed output falls below the target bit-rate $E_{TGT}$, the unused bit-rate capacity is ignored in quantizing subsequent blocks. Alternatively, extra bits from a previous block are allocated to the target bit-rate for the current block, so long as the average bit-rate over a span of blocks satisfies a bandwidth target to prevent buffer overflow and underflow.

The quantizer sets (440) a heuristic model of actual bit-rate of compressed output versus quantization threshold. The quantizer sets the heuristic model according to a model for spectral audio data, the spectral energy of the block, and any feedback from previous iterations. The quantizer calculates (450) a quantization threshold T based upon the heuristic model and quantizes (460) the block of data using the calculated T. Each spectral coefficient $s_t$ is quantized by T according to the formula:

$$q_i = \text{round}\left(\frac{s_i}{2T}\right); \tag{1}$$

where round(x) is the integer nearest to x. Alternatively, another quantization formula is used, for example, one that divides $s_t$ by T instead of 2T, with corresponding changes to the heuristic model.

The quantizer determines (470) whether the quantization threshold is acceptable. For example, the quantizer compares the actual bit-rate $E_x$ of the compressed output to the target bit-rate $E_{TGT}$ to determine if the actual bit-rate is below but sufficiently close to the target bit-rate. Other acceptability criterion are possible, for example, proximity to the target bit-rate, proximity to a target distortion or distance between quantization thresholds in successive iterations. In an alternative embodiment, the quantizer tests a candidate quantization threshold after finding an acceptable quantization threshold to verify that no better quantization threshold exists. The cost of this extra iteration can be justified if an application that is extremely sensitive to distortion in the data and the likelihood of finding a better quantization threshold is non-negligible.

If the quantization threshold is acceptable, the quantization loop finishes for that block. If the quantization threshold is not acceptable, the quantization loop again sets (440) the heuristic model, now considering the resulting actual bit-rate from the previous iteration.

After the quantizer finds an acceptable quantization threshold, the quantizer determines (480) whether any more blocks of spectral data remain to be quantized. If so, the quantizer gets (420) the next block and continues from that point. Otherwise, the quantizer finishes (490).

In an alternative embodiment, the quantizer applies different heuristic models to different blocks for blocks that have different statistical characteristics (e.g., blocks of low frequency range spectral data vs. blocks of high frequency range spectral data).

A. Heuristic Model for Spectral Audio Data

In the quantization loop, the heuristic model determines an initial quantization threshold and improves selection of subsequent quantization thresholds. The initial parameters of the heuristic model depend on the type of data being compressed, and can be set through training or statistical analysis.

In general, the problem of finding a quantization threshold that is optimal for a target bit-rate cannot be solved a priori due to the complex, non-linear dependencies between the quantized output and the compression techniques used on the quantized output. For quantization of arbitrary, unknown data, the binary search approach described above may be optimal.

Input signals of a particular data type, however, typically have similarities that can be exploited to tune a quantization loop. For example, one feature of audio (and video) data is that the distribution of spectral data is not uniform. Smaller value spectral data is more frequent that larger value data, and prevails in the output of a quantizer. Table 2 gives a distribution of quantized spectral coefficients for music and speech encoded with a subject audio encoder.

TABLE 2

Distribution of quantized spectral data for music and speech

| $\lvert q_i \rvert$ | Frequency of Occurrence | Encoded Size (in bits) |
|---|---|---|
| 0 | 78.0% | .75 |
| 1 | 14.5% | 2 |
| 2 | 4.5% | 4 |
| 3 | 2.0% | 6 |
| >3 | <1.0% | >6 |

Table 2 gives summary results for several sequences of audio data. For any given block of spectral audio data, the frequencies of occurrence will vary as the quantization threshold varies. For the summary distribution and expected bit-allocation of Table 2, however, the actual bit-rate E(S,T) of a typical block of quantized spectral audio data S is approximately:

$$E(S, T) \approx \sum_{|q_i|=0} 0.75 + \sum_{|q_i|>0} 2|q_i|; \tag{2}$$

Assuming for the sake of simplicity that spectral coefficients $s_i$ are uniformly distributed in the range (−T,T), corresponding quantized values are:

$$q_i = \text{round}\left(\frac{s_i}{2T}\right) \approx \frac{s_i}{2T}; \tag{3}$$

$q_i$ is equal to zero if $|s_i|<T$, and the average value of a spectral coefficient quantized to zero is $|s_i|=0.5T$. Also assuming for the sake of simplicity that the spectral coefficients are uniformly distributed in higher quantization levels as well, by substitution equation (2) becomes:

$$E(S, T) \approx \sum_{|s_i|<T} \left(0.25 + 2\frac{|s_i|}{2T}\right) + \sum_{|s_i|\geq T} 2\frac{|s_i|}{2T}; \tag{4}$$

As noted in Table 2, roughly 80% of typical quantized spectral audio data is 0 value. Factoring this observation into equation (4) yields the equation:

$$E(S, T) \approx 0.2N + \frac{1}{T}\sum_{i=0}^{N} |s_i|; \tag{5}$$

where N is the number of spectral coefficients in the block. Equation (5) can be expressed more simply as:

$$E(S, T) \approx 0.2N + \frac{|S|}{T}; \tag{6}$$

where |S| is the cumulative energy of the spectral coefficients.

While the derivation of equations (2)–(6) depended upon statistical analysis of typical quantized spectral audio data for the subject audio encoder, a generalization of equation (5) can be applied to other forms of data:

$$E(S, T) \approx C_1 N + \frac{C_2}{T}|S|; \tag{7}$$

where $C_1$ and $C_2$ are implementation-dependent coefficients that can be derived by statistical analysis and |S| is the cumulative energy of the spectral coefficients.

Alternatively, instead of statistical analysis, the coefficients of equations (5) or (7) can be determined through training on a set of typical data. For the subject audio encoder, for example, the coefficients $C_1$ and $C_2$ can be determined by minimizing mean square error between actual bit-rates and bit-rates predicted by the heuristic model across a set of representative audio sequences.

B. Iterations of the Quantization Loop

For an initial approximation $T_1$ of the final quantization threshold, the quantizer considers the target bit-rate $E_{TGT}$, the cumulative spectral energy |S| of the block of spectral audio data, and a factor of the number N of spectral coefficients in the block. The quantizer applies this factors to equation (6):

$$T_1 = \frac{|S|}{E_{TGT} - 0.2N}; \tag{8}$$

If the actual bit-rate $E(S,T_1)$ of compressed output quantized by the initial approximation $T_1$ is not acceptable, the quantizer performs one or more additional iterations of the quantization loop.

For a second approximation $T_2$, the quantizer adjusts the previous approximation $T_1$ by the proportion by which the first actual bit-rate $E(S,T_1)$ deviated from the target output bit-rate $E_{TGT}$. The quantizer relates the results of the first iteration to the target bit-rate $E_{TGT}$ and $T_2$ using the equation:

$$E(S, T) \approx \frac{C}{T}|S|; \tag{9}$$

where C is a coefficient relating the first two iterations and |S| is the cumulative energy of the spectral coefficients. Solving equation (9) for C with the results of the first iteration, and then solving equation (9) for $T_2$ with C and $E_{TGT}$ yields the equation:

$$T_2 = C\frac{|S|}{E_{TGT}} = \frac{T_1 E(S, T_1)}{|S|}\frac{|S|}{E_{TGT}} = \frac{T_1 E(S, T_1)}{E_{TGT}}; \tag{10}$$

Alternatively, instead of equations (9) and (10), a modified version of equation (5) can be used to find the second approximation $T_2$, where the coefficient C modifies the cumulative spectral energy. In experiments, equation (10) gave better results for the second approximation $T_2$ for spectral audio data than the modified version of equation (5).

If the actual bit-rate $E(S,T_2)$ of compressed output quantized by the second approximation $T_2$ is not acceptable, the quantizer performs one or more additional iterations of the quantization loop.

For any subsequent iterations, the quantizer approximates a quantization threshold $T_k$ based upon the results of the previous two iterations. The quantizer uses the equation:

$$E(S, T_k) \approx C_1 N + \frac{C_2}{T_k}|S|; \tag{11}$$

where $C_1$ and $C_2$ are deduced from the results of the first two equations. For example, for the third iteration, the results of the first iteration are put in a first equation (11), the results of the second iteration are put in a second equation (11), and the two equations are solved for $C_1$ and $C_2$. The values for $C_1$, $C_2$, and $E_{TGT}$ are then substituted into equation (11), which is then solved for $T_k$:

$$T_k = \frac{C_2|S|}{E_{TGT} - C_1 N}; \quad (12)$$

If the actual bit-rate $E(S,T_k)$ of compressed output quantized by the k-th approximation $T_k$ is not acceptable, the quantizer performs an additional iteration of the quantization loop using equation (12) and coefficients $C_1$ and $C_2$ with values deduced from the most recent two iterations.

Figure 5:
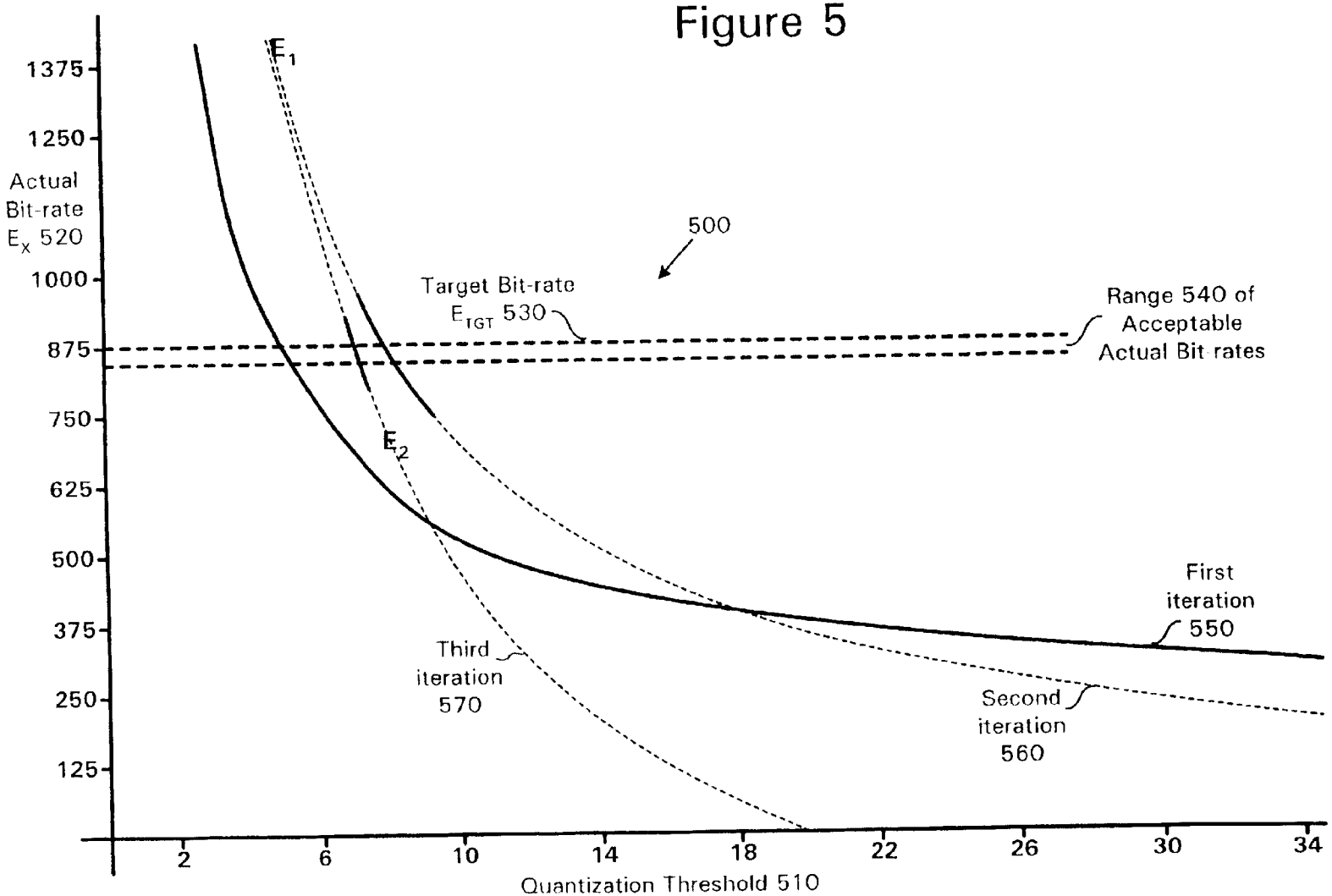
FIG. 5 is a graph showing the heuristic model of actual bit-rate versus quantization threshold through three iterations of the quantization loop of the illustrative embodiment.

FIG. 5 is a graph (500) showing the heuristic model as it changes through three iterations of the quantization loop. The quantization loop determines a quantization threshold for a block of hypothetical spectral audio data then encoded with a hypothetical audio encoder.

The heuristic model relates actual bit-rate $E_X$ (520) as a function of quantization threshold (510). The target bit-rate $E_{TGT}$ (530) is 875 bits. The quantization loop continues until the actual bit-rate $E_X$ falls within the range (540) of acceptable actual bit-rates under the target bit-rate $E_{TGT}$ (530). In FIG. 5, the range (540) includes actual bit-rates up to 3% less than the target bit-rate (530). So any output bit-rate greater than 875*(1−0.03)=849 bits and less than or equal to 875 bits is acceptable. Other ranges (e.g., 0%, 5%, 7%) are possible. The size of the range is an implementation decision that balances output quality against the costs of the extra iterations needed to achieve the highest possible quality for a target bit-rate.

In FIG. 5, the cumulative spectral energy |S| is 3400 for the 1000 coefficients of the input block. The graph for the first iteration (550) shows the following equation based on equation (6), which includes parameters $C_1$ and $C_2$ set for typical spectral audio data:

$$E(S, T_1) \approx 200 + \frac{3400}{T_1}; \quad (13)$$

Solving equation (13) for $T_1$ with the target bit-rate $E_{TGT}$ of 875 bits gives a quantization threshold $T_1$=5.04≈5. Applying $T_1$ to the spectral data, however, results in actual bit-rate of 1400 bits for the compressed output.

The graph for the second iteration (560) shows the following equation based on equation (10) and adapted according to the results of the first iteration:

$$E(S, T_2) \approx \frac{5 * 1400}{T_2}; \quad (14)$$

Solving equation (14) for $T_2$ with the target bit-rate $E_{TGT}$=875 bits gives a quantization threshold $T_2$=8. Applying $T_2$ to the spectral data, however, results in actual bit-rate of 700 bits for the compressed output.

The graph for the third iteration (570) shows the following equation based on equation (11) and adapted according to the results of the previous two iterations:

$$E(S, T_3) \approx -0.47 * 1000 + \frac{2.75 * 3400}{T_3}; \quad (15)$$

Solving this equation for $T_3$ with the target bit-rate $E_{TGT}$=875 bits gives a quantization threshold $T_3$=7. Applying $T_3$ to the spectral data results in actual bit-rate of 850 bits, which is within the 3% range (540) of the target bit-rate (530).

In alternative embodiments, a heuristic model with a different number or arrangement of parameters relates actual bit-rate of output following compression to quantization threshold for a block of data.

C. Performance of the Quantization Loop with Heuristic Approach

Experiments with the subject audio encoder on a broad selection of speech and music sequences show that equation (8) yields an acceptable quantization threshold in the first iteration 20–40% of the time. In other words, 20–40% of the time, the resultant actual bit-rate $E(S,T_1)$ is close enough below the target output bit-rate $E_{TGT}$ that the quantization loop ceases after the first iteration. When a second iteration is required, equation (10) yields an acceptable quantization threshold in the second iteration about 70% of the time. When a third iteration is required, equation (12) yields an acceptable quantization threshold in the third iteration about 95% of the time.

Compared to the prior art quantization loop with a binary search approach which requires 5–8 iterations on average (depending on implementation in different encoders), the quantization loop with a heuristic approach requires 2 iterations on average for spectral audio data. The quantization loop with a heuristic approach reduces total encoding time by 5–40%, depending on the encoder used and bit-rate/quality of the data.

Having described and illustrated the principles of my invention with reference to an illustrative embodiment, it will be recognized that the illustrative embodiment can be modified in arrangement and detail without departing from such principles. It should be understood that the programs, processes, or methods described herein are not related or limited to any particular type of computing environment, unless indicated otherwise. Various types of general purpose or specialized computing environments may be used with or perform operations in accordance with the teachings described herein. Elements of the illustrative embodiment shown in software may be implemented in hardware and vice versa. The equations described above represent the results of computer operations in a form that facilitates understanding. The actual computer operations leading to the result of an equation can vary depending on implementation.

In view of the many possible embodiments to which the principles of my invention may be applied, I claim as my invention all such embodiments as may come within the scope and spirit of the following claims and equivalents thereto.

I claim:

1. In a computer system with a spectral audio data encoder having an actual bit-rate feedback, uniform, scalar quantizer, a method for reducing the number of iterations of a quantization loop for a block of spectral audio data, the method comprising:

a) setting a polynomial that relates actual bit-rate to quantization threshold for spectral audio data in an actual bit-rate feedback, uniform, scalar quantizer, the initial coefficients for the polynomial set for typical spectral audio data;

b) calculating a candidate quantization threshold for a block of spectral audio data based upon the polynomial;

c) quantizing the block of data with the candidate quantization threshold;

d) measuring bit-rate of output following compression of the quantized block;

e) if the measured bit-rate falls within a pre-determined range below a target bit-rate, designating the candidate quantization threshold as final quantization threshold;

else adjusting one or more coefficients of the polynomial and repeating b)–e).

2. A computer-readable medium storing instructions for a method of reducing the number of iterations of a quantization loop, the method comprising:

a) setting a model that relates actual bit-rate to uniform, scalar quantization threshold for a data type in an actual bit-rate feedback quantizer;

b) calculating a candidate uniform, scalar quantization threshold for a block of input data based upon the model;

c) quantizing the block of input data with the candidate quantization threshold;

d) measuring bit-rate of output following compression of the quantized block;

e) if the measured bit-rate is acceptable, designating the candidate quantization threshold as final quantization threshold for the block of input data;

else adjusting the model and repeating b)–e) with the model as adjusted.

3. The computer-readable medium of claim 2 wherein initial parameters for the model are set for typical spectral audio data.

4. The computer-readable medium of claim 2 wherein, calculating a candidate quantization threshold in a first iteration comprises computing a first approximation $T_1$ equal to $$\frac{|S|}{E_{TGT} - C_1 N},$$

wherein |S| is cumulative spectral energy for the block, $E_{TGT}$ is a target bit-rate, $C_1$ is a first coefficient, and N is the number of points of input data in the block, calculating a candidate quantization threshold in a second iteration comprises computing a second approximation $T_2$ equal to $$\frac{T_1 E(S, T_1)}{E_{TGT}},$$

where $E(S,T_t)$ is the measured bit-rate of the first iteration, and calculating a candidate quantization threshold in subsequent iterations comprises computing a subsequent approximation $T_k$ equal to $$\frac{C_2|S|}{E_{TGT} - C_1 N},$$

wherein $C_2$ is a second coefficient, and $C_1$ and $C_2$ reflect the results of previous iterations.

5. The computer-readable medium of claim 2 wherein the measured bit-rate is acceptable if the measured bit-rate lies within a predetermined range around a target bit-rate.

6. The computer-readable medium of claim 2 wherein the measured bit-rate is acceptable if the measured bit-rate lies within a predetermined range around a target bit-rate or if the output with the measured bit-rate has less than a predetermined target distortion.

7. A computer-readable medium storing instructions for a method of dequantizing the block of input data quantized according to the method of claim 2, the method comprising:

receiving the block of input data; and applying the final quantization threshold to the block of input data in inverse quantization.

8. In a computer system with an encoder having a quantizer, a method for finding a quantization threshold using a quantization loop with a heuristic approach, the method comprising:

estimating a quantization threshold based upon a heuristic model of actual bit-rate versus quantization threshold, wherein the model adjusts responsive to negative evaluation of an acceptability criterion for the estimated quantization threshold; and evaluating whether bit-rate of compressed output quantized by the estimated quantization threshold satisfies the acceptability criterion and if so, designating the estimated quantization threshold as final quantization threshold, and if not, adjusting the model and repeating the estimating and evaluating with the model as adjusted.

9. The method of claim 8 wherein the quantization threshold is a uniform, scalar quantization threshold.

10. The method of claim 8 wherein the model is initially parameterized for typical spectral audio data.

11. The method of claim 8 wherein estimating a quantization threshold in a first iteration comprises computing a first approximation $T_1$ equal to $$\frac{|S|}{E_{TGT} - C_1 N},$$

wherein |S| is cumulative spectral energy for a block of data, $E_{TGT}$ is a target bit-rate, $C_1$ is a first non-zero coefficient, and N is the number of points of data in the block.

12. The method of claim 11 wherein estimating a quantization threshold in a second iteration comprises computing a second approximation $T_2$ equal to $$\frac{T_1 E(S, T_1)}{E_{TGT}},$$

where $E(S,T_1)$ is the bit-rate of compressed output from the first iteration.

13. The method of claim 12 wherein estimating a quantization threshold in a subsequent iteration comprises computing a subsequent approximation $T_k$ equal to $$\frac{C_2|S|}{E_{TGT} - C_1 N},$$

wherein $C_2$ is a second non-zero coefficient, and $C_1$ and $C_2$ reflect the results of previous iterations.

14. The method of claim 8 wherein the acceptability criterion comprises proximity of the evaluated bit-rate to a target-bit-rate.

15. The method of claim 14 wherein the acceptability criterion further comprises satisfaction of a minimum logarithmic distance threshold between quantization thresholds in successive iterations.

16. A method of dequantizing compressed output quantized by the estimated quantization threshold designated as the final quantization threshold according to the method of claim 8, the method comprising:

receiving the compressed output;

decompressing the compressed output; and applying the final quantization threshold to the decompressed output in an inverse quantization operation.

17. In a computer system, a bit-rate feedback quantizer comprising:

a threshold estimator for estimating a quantization threshold based upon a model of actual bit-rate versus quantization threshold, wherein the threshold estimator adjusts the model responsive to a negative evaluation of an acceptability criterion for the quantization threshold; and a threshold evaluator for evaluating actual bit-rate of output following compression, the threshold evaluator further evaluating whether the estimated quantization threshold satisfies the acceptability criterion.

18. The quantizer of claim 17 wherein the threshold estimator adjusts parameters of the model initially set according to data type.

19. The quantizer of claim 18 wherein the data type is spectral audio data.

20. The quantizer of claim 17 wherein the acceptability criterion comprises proximity of the actual bit-rate to a target-bit-rate.

21. The quantizer of claim 17 wherein the quantization threshold is a uniform, scalar quantization threshold.

22. A computer-readable medium storing instructions for a bit-rate feedback quantizer with a heuristic approach, the quantizer comprising:

means for estimating a quantization threshold based upon a heuristic model of actual bit-rate as a function of quantization threshold, wherein the means for estimating adjusts one or more parameters of the model responsive to a negative evaluation of acceptability of the estimated quantization threshold; and means for evaluating actual bit-rate following compression of output quantized by the estimated quantization threshold, wherein the means for evaluating further evaluates the acceptability of the estimated quantization threshold.

23. A computer-readable medium storing instructions for a method of dequantizing a block of input data quantized in a bit-rate feedback quantizer with a heuristic approach, the method comprising:

receiving a block of quantized input data, the input data quantized by a bit-rate feedback quantizer with a heuristic approach; the quantizer including a threshold estimator and a threshold evaluator, the threshold estimator for estimating a quantization threshold based upon a heuristic model of actual bit-rate versus quantization threshold, wherein the threshold estimator adjusts the model responsive to a negative evaluation of an acceptability criterion for the estimated quantization threshold, the threshold evaluator for evaluating actual bit-rate following compression of output quantized by the estimated quantization threshold, wherein the threshold evaluator further evaluates whether the estimated quantization threshold satisfies the acceptability criterion; and applying the final quantization threshold to the block of quantized input data in inverse quantization.

* * * * *

UNITED STATES PATENT AND TRADEMARK OFFICE

CERTIFICATE OF CORRECTION

PATENT NO. : 7,062,445 B2
APPLICATION NO. : 09/771371
DATED : June 13, 2006
INVENTOR(S) : Kadatch It is certified that error appears in the above-identified patent and that said Letters Patent is hereby corrected as shown below:

Title Page On page 2, Item (56), under "Other Publications", in column 1, line 14, delete "Committe" and insert -- Committee --, therefor.

Title Page On page 2, Item (56), under "Other Publications", in column 2, line 48, delete "Constained" and insert -- Constrained --, therefor.

In column 6, line 30, delete "$a_j$," insert -- $a_1$, --, therefor.

In column 8, line 2, delete "$s_t$" and insert -- $s_i$ --, therefor.

In column 8, line 11, delete "$s_t$" and insert -- $s_i$ --, therefor.

In column 8, line 15, delete "$E_x$" and insert -- $E_X$ --, therefor.

In column 9, line 32, delete "$| s_t | =0.5T$." and insert -- $| s_i | =0.5T$. --, therefor.

In column 13, line 44, in Claim 4, delete "$E(S,T_t)$" and insert -- $E(S,T_1)$ --, therefor.

Signed and Sealed this

Twentieth Day of April, 2010

David J. Kappos

David J. Kappos
*Director of the United States Patent and Trademark Office*